US005967605A

United States Patent [19]

Stanfield

[11] Patent Number: 5,967,605

[45] Date of Patent: Oct. 19, 1999

[54] FOLDING CHAIR WITH STACKING DEVICE

[76] Inventor: John Stanfield, 425 Riverhill Dr., Atlanta, Ga. 30328

[21] Appl. No.: 09/256,271

[22] Filed: Feb. 23, 1999

[51] Int. Cl.[6] ..... A47C 3/04

[52] U.S. Cl. ..... 297/239

[58] Field of Search ..... 297/239; 108/53.1, 108/91; 211/794; 248/501

[56] References Cited

U.S. PATENT DOCUMENTS

| | | | |
|---|---|---|---|
| 4,010,978 | 3/1977 | Rosen | 297/239 |
| 5,096,259 | 3/1992 | Stanfield | 297/239 |
| 5,345,879 | 9/1994 | Maillard | 108/53.1 |
| 5,738,408 | 4/1998 | Wu | 297/239 |

*Primary Examiner*—Peter R. Brown
*Attorney, Agent, or Firm*—Kennedy, Davis & Hodge

[57] ABSTRACT

A brace for a folding chair comprised two pieces of like construction with each piece having a support surface in a central portion of the brace sized and shaped to be fitted snugly about one side of a leg of a folding chair. Two flange portions straddle the central portion. One of the flange portions is formed with a groove and the other with a tongue of a shape and size to be fitted into the groove. Stacked chairs to which the braces are mounted with the tongue of one brace fitted into the groove of the brace of the other chair are held in a stable stack.

6 Claims, 2 Drawing Sheets

FOLDING CHAIR WITH STACKING DEVICE

TECHNICAL FIELD

This invention relates to chairs of the type that may be folded and stacked.

BACKGROUND OF THE INVENTION

Hotels and caterers use folding chairs for special events since they can be folded into generally flat configurations so that they may be compactly transported and stored for space economy and moving efficiency. However, many models of folding chairs cannot be stacked in a horizontal position one on top of the other because they will not "nest" or lock into place. Such chairs are normally stored and transported in a vertical position and, since they stand on only two legs, must be held in such position by a rack or cart built for that purpose. The number of chairs stored or transported is limited by the size of the rack or cart. Another problem associated with storing or transporting in this manner is that the chairs are unstable and prone to tipping. They also slide and move against each other causing them to be scratched or otherwise marred. One attempted solution to these problems has been the construction of racks and carts on which the chairs are suspended on hooks. All such racks and carts, whether for standing or hanging the chairs, are bulky, awkward and expensive.

Heretofore folding chairs have been retrofitted with interlocking braces to prevent them from slipping and shifted when mounted in a stack. My prior U.S. Pat. No. 5,096,256 describes such a brace for folding chairs of the type housing rectangular, wooden legs. The brace is constructed with a lug on one side and a stop on its opposite side that is offset from the lug. With two braces screwed to the chair legs, lengthwise sliding movement of one chair upon another is limited by engagement of the brace lugs with brace stops of an adjacent chair.

Though the just described devices have worked well on folding chairs having rectangular, wooden legs, they are ill suited for use on metallic folding chairs with round legs. Holes would have to be drilled through the metal legs for mounting the braces. Once mounted the braces would easily become skewed since they would have only a point of contact with the cylindrical leg instead of being flush with their flat surface abutting the flat leg. Moreover, they would not prevent lateral shifting since the brace of one would not overlay the leg of the adjacent chair.

Accordingly, it is seen that a need has long remained for some mechanism or device by which folding chairs of the type having round legs could be stacked securely without shifting or sliding upon one another. It is to the provision of such therefore that the present invention is primarily directed.

SUMMARY OF THE INVENTION

Briefly described, a brace for a folding chair comprises two pieces of like construction with each piece having a support surface in a central portion of the brace that is sized and shaped to be fitted snugly about one side of a leg of a folding chair. The brace has two flange portions which straddle the central portion. One of the flange portions is formed with a groove while the other is formed with a tongue of a shape and size to be fitted into the groove. Stacked chairs to which the braces are mounted with the tongue of one brace fitted into the groove of the brace of the adjacent chair are thus held in a stable stack.

BRIEF DESCRIPTION OF THE DRAWING

FIG. 1 is a partially exploded side view of two identical interlocked braces that embody principles of the invention in its preferred from.

DETAILED DESCRIPTION

Figure 1:
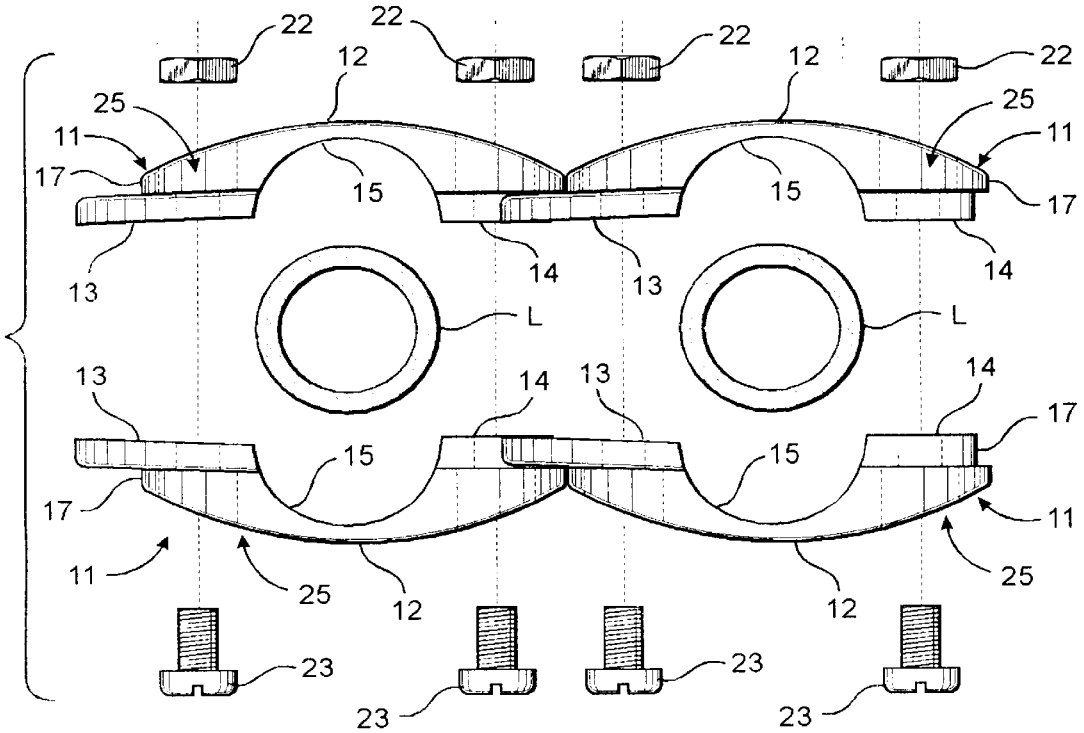
Figure 2:
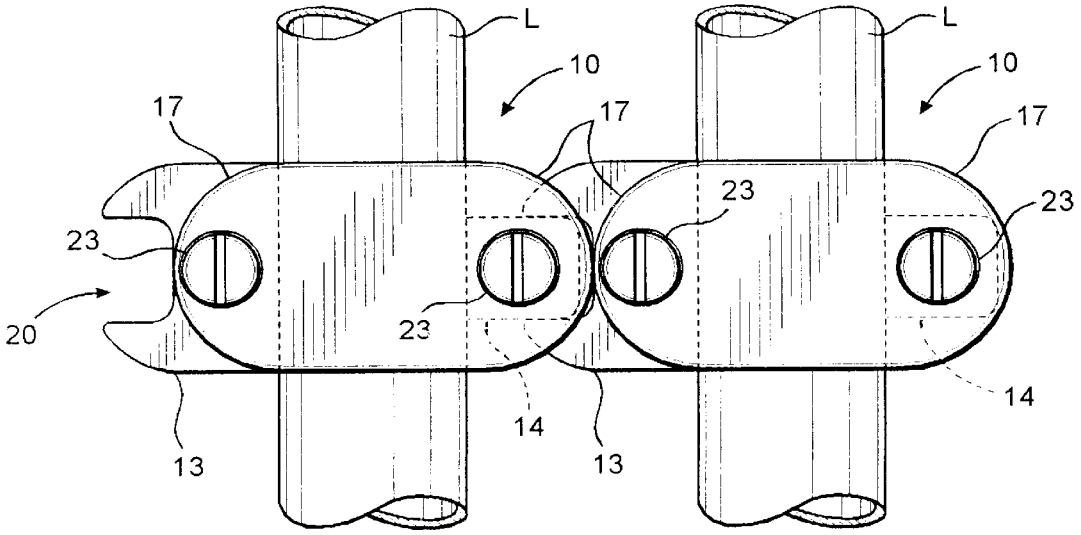
FIG. 2 is a face view of the two braces of FIG. 1 shown mounted to chair legs.

Referring now in more detail to the drawing, there is shown in FIGS. 1 and 2 two braces 10 of identical construction. Each brace is made of two identical pieces 11 which have a dome portion 12 from which two flanges 13 and 14 extend. One side of the dome portion is convex while its opposite side has a semicylindrical support surface 15 which is sized to be fitted snugly to a cylindrical chair leg L. As seen in FIG. 2, each end 17 of the dome portion is also semicylindrical. Note that one of its ends 13 extends slightly beyond the flange 14 while its other end 17 terminates well short of the other flange 13.

As also shown in FIG. 2, the flange 13 has the appearance of a common wrench and has a recess or groove 20. Conversely, the flange 14, which is coplanar with the groove, is generally square and provides a tongue that is sized to be snugly slid into the groove 20 of an adjacent brace. Note further that when two braces are interlocked, as shown in FIGS. 1 and 2, that their rounded ends 17 come into point contact abutment just before a tongue 14 reached the bottom end of the groove 20.

Figure 3:
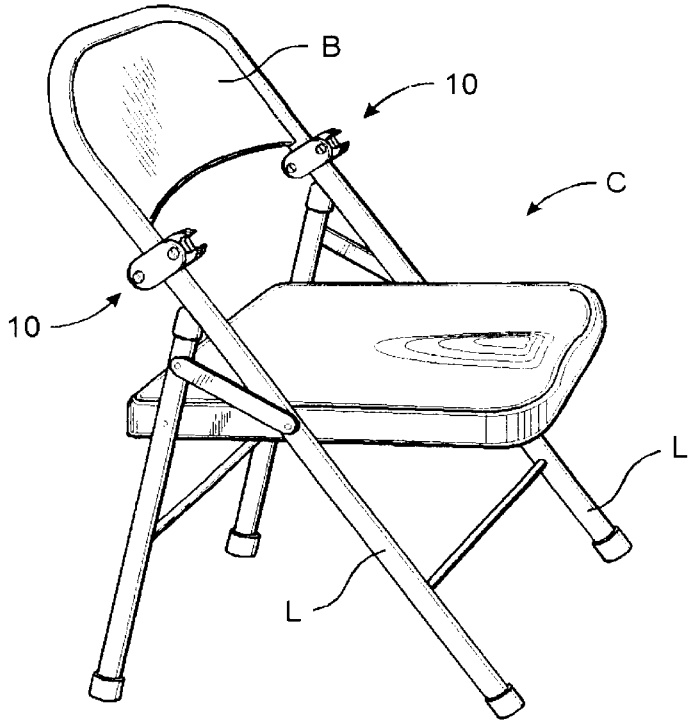
FIG. 3 is a perspective view of a folding chair equipped with the braces.

The braces 10 are also provided with means for fastening their two pieces securely about a chair leg L. This is in the form of two nuts 22 and bolts 23. The bolts 23 are inserted into countersunk holes 25 with the enlarged countersink portions being in the dome portion and the smaller remainder of the holes being in the flanges. Thus once the bolts are threaded into the nuts, both the heads of the bolts and the nuts are recessed. The braces 10 are mounted on folding chairs C as shown in FIG. 3. More specifically, they are mounted to the upper portion of the leg just beneath the chair back B, preferably with the flanges with grooves facing forward.

Figure 4:
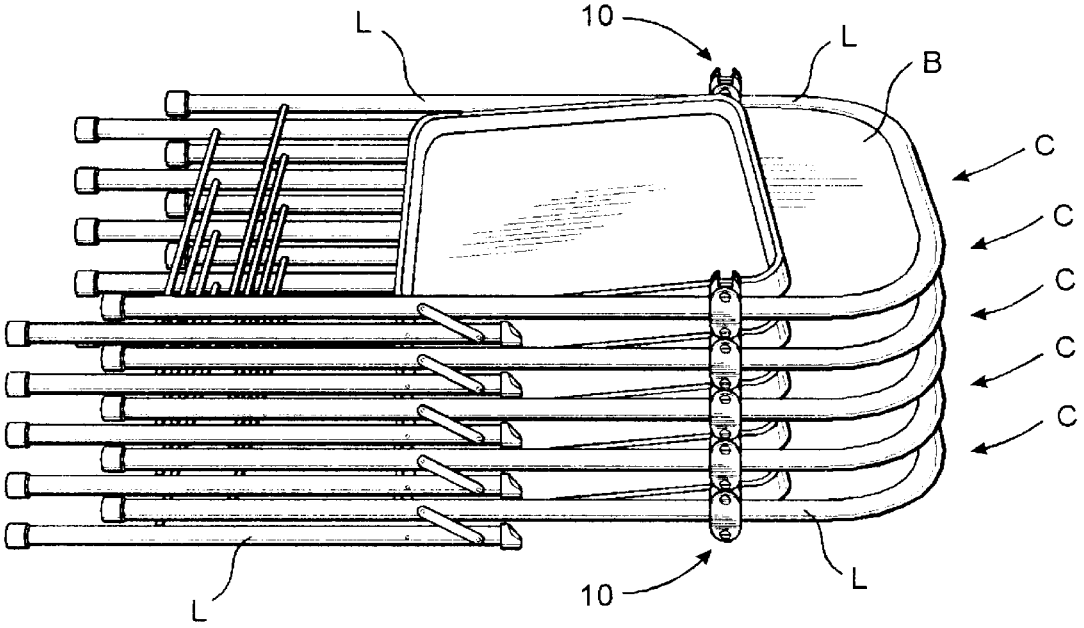
FIG. 4 is a perspective view of a stack of chairs of the type shown in FIG. 3.

In use chairs equipped with the braces may be stacked into a stack as shown in FIG. 4. With the chairs aligned the tongue of one brace flange is inserted into the groove of the flange of the adjacent brace. Once this is done one chair cannot slide lengthwise upon the other because of their tongue-in-groove interlock. Note that the upper portions of their legs L are actually lifted off each other which prevents marring. Additionally, one cannot shift sideways with respect to the other because, as appreciated from FIG. 2, a portion of the dome over the tongue of its flange overlaps a portion of the grooved flange of the mating brace. Except for stack end members, this is true bidirectionally. The other ends of the chairs are supported by the rubber foot tip of one abutting the leg of the adjacent chair. Chairs such as Meco are supported in this manner. Other chair designs may actually have tip to tip contact.

To unstack the chairs the top one is merely lifted from the one beneath it. Since the point of dome to dome contact prevents the tongues from becoming firmly wedged into the groove of another, and stuck, which can easily happen in a tall, weighted stack, they separate easily.

It thus is seen that a brace is now provided for folding chairs with round legs that enables the chairs to be readily stacked and unstacked securely. While the invention has been shown in its preferred form, it should be understood that many modifications, additions and deletions may be made to this form without departure from the spirit and scope of the invention as set forth in the following claims.

I claim:

1. In a stackable, folding chair of the type having a pair of rounded front legs, a pair of back legs, a seat and a back adapted to be folded in a generally flat configuration, the improvement comprising means for stably stacking one folding chair upon another that comprises a brace having two mating pieces with each piece having a concave support surface contoured to be placed flushly to one side of a rounded chair leg and with said support surface being straddled by two flanges with one flange having a tongue and the other flange having a groove sized and shaped to receive the tongue, and means for fastening said two pieces securely to the leg, whereby upon stacking chairs to which the braces are mounted with adjacent braces interlocked in tongue and groove fashion, adjacent chairs are securely supported with their rounded legs inhibited from sliding.

2. The improvement of claim 1 wherein each flange of each piece has countersunk hole therethrough, and wherein said fastening means comprises a pair of nuts and bolts with heads, said nuts and bolt heads being sized to be received in the countersinks of said countersunk holes.

3. The improvement of claim 2 wherein one countersunk hole of each of said pieces extends partially through a flange tongue.

4. The improvement of claim 1 wherein each brace piece has a dome portion that provides said concave support surface and which extends symmetrically and equilaterally to each side from said concave support surface over said two flanges distances sufficient for contact with an adjacent brace dome of like construction that is interlocked therewith in tongue and groove fashion.

5. A brace for a folding chair comprising two pieces of like construction with each piece having a support surface in a central portion of the brace sized and shaped to be fitted snugly about one side of a leg of the folding chairs and two flange portions which straddle said central portion, and wherein one of said flange portions is formed with a groove and the other of said flange portions is formed with a tongue of a shape and size to be fitted into said groove, whereupon stacking chairs to which the braces are mounted with the tongue of one brace fitted into the groove of the brace of the other chair, the chairs are held in a stable stack.

6. The brace of claim 5 wherein said flange groove and said flange tongue are coplanar and wherein said brace has a portion adjacent to but offset from the plane of said tongue and groove that extends to each side of said tongues whereby adjacent chairs in a stack with mating braces are supported by their braces with at least portions of their legs separated and prevented from shifting.

* * * * *